US006475020B1

(12) United States Patent
Jones et al.

(10) Patent No.: US 6,475,020 B1
(45) Date of Patent: Nov. 5, 2002

(54) IDC CONNECTOR ASSEMBLY

(75) Inventors: Dennis B. Jones, Orange, CA (US); Raj Sekhar, Cypress, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/028,150

(22) Filed: Dec. 20, 2001

(51) Int. Cl.[7] ..... H01R 11/20
(52) U.S. Cl. ..... 439/425; 439/417
(58) Field of Search ..... 439/417, 425, 439/387

(56) References Cited

U.S. PATENT DOCUMENTS 5,549,484 A * 8/1996 Chen ..... 439/417
6,050,845 A * 4/2000 Smalley et al. ..... 439/417

* cited by examiner

*Primary Examiner*—Tho D. Ta
(74) *Attorney, Agent, or Firm*—Wei Te Chung

(57) ABSTRACT

An IDC connector assembly (10) mounted to a PCB (20) includes an IDC connector (30) and a wire (40). The IDC connector includes a housing (32) defining a hollow portion (322) having an entrance (323) and an exit (324), and a terminal (34) received in the hollow portion. The terminal includes a base portion (341), a solder portion (342) extending downwardly from the base portion and further extending outside the exit of the hollow portion for being soldered to the PCB, a pair of arm portions (343) extending from the base portion into the hollow portion, and a pair of head portions (344) respectively formed on the arm portions. The wire extends into the hollow portion of the housing from the entrance to be located between the pair of arm portions, and the pair of head portions pierces into the wire so that electrical connection is established between the wire and the terminal.

5 Claims, 6 Drawing Sheets

IDC CONNECTOR ASSEMBLY

BACKGROUND OF THE INVENTION

1. Field of the Invention

The present invention relates to an IDC (insulation displacement connection) connector assembly, and particularly to an IDC connector assembly having a wire electrically connecting to a PCB (printed circuit board) perpendicular to the wire.

2. Description of Related Art

Many industries using electronic PCB have a need to attach a single wire to the PCB without using a terminal block or connector that both take up a lot of space and cost more than users want to spend.

If there is a vertical insulation displacement design that would allow termination to a single wire, this would have a use in every industry. If it could be contained on a PCB or termination plane as a single assembly where there are no loose pieces this would be a plus. It would be nice to have a design where it suffices to only insert a wire followed by a pushing down operation to have a complete connection.

SUMMARY OF THE INVENTION

Accordingly, a first object of the present invention is to provide an IDC connector assembly easy for electrically connecting a wire to a PCB.

A second object of the present invention is to provide an IDC connector assembly easy to be manufactured.

A third object of the present invention is to provide a low cost IDC connector assembly.

In order to achieve the objects set forth, an IDC connector assembly mounted to a PCB comprises an IDC connector and a wire. The IDC connector comprises a housing defining a hollow portion having an entrance and an exit and a terminal received in the hollow portion. The terminal comprises a base portion, a solder portion extending downwardly from the base portion and further extending outside of the exit and soldered to the PCB, a pair of arm portions extending from the base portion into the hollow portion, and a pair of head portions separately formed on the arm portions. The wire extends into the hollow portion of the housing from the entrance to locate between the pair of arm portions, the pair of head portions pierces into the wire so that electrical connection is established between the wire and the terminal.

Other objects, advantages and novel features of the invention will become more apparent from the following detailed description when taken in conjunction with the accompanying drawings.

DETAILED DESCRIPTION OF THE INVENTION

Figure 1:
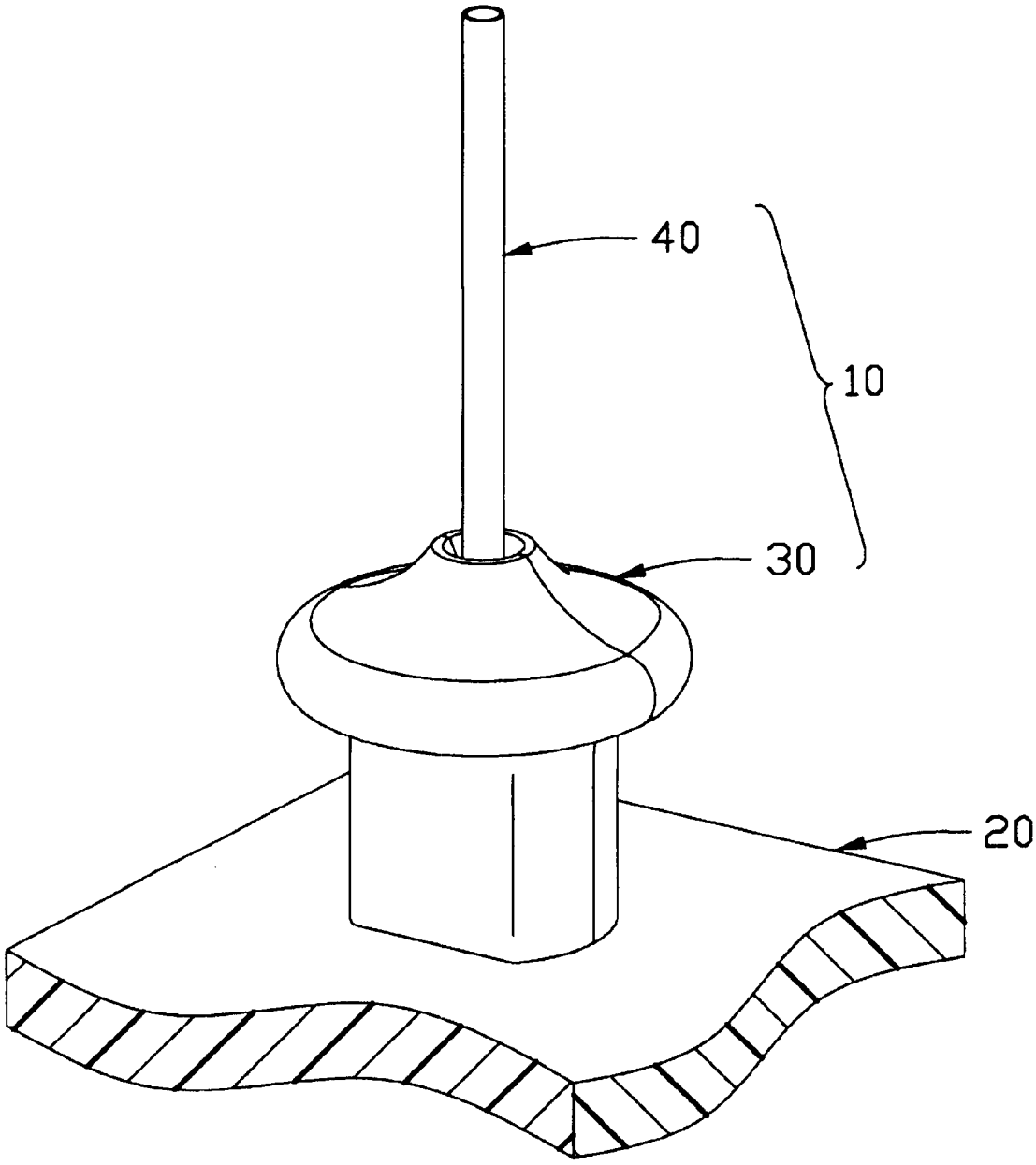
FIG. 1 is a perspective view of an IDC connector assembly soldered to a PCB.

Referring to FIG. 1, an IDC (insulation displacement connection) connector assembly 10 mounted to a PCB (printed circuit board) 20 of the present invention comprises an IDC connector 30 and a wire 40.

Figure 2:
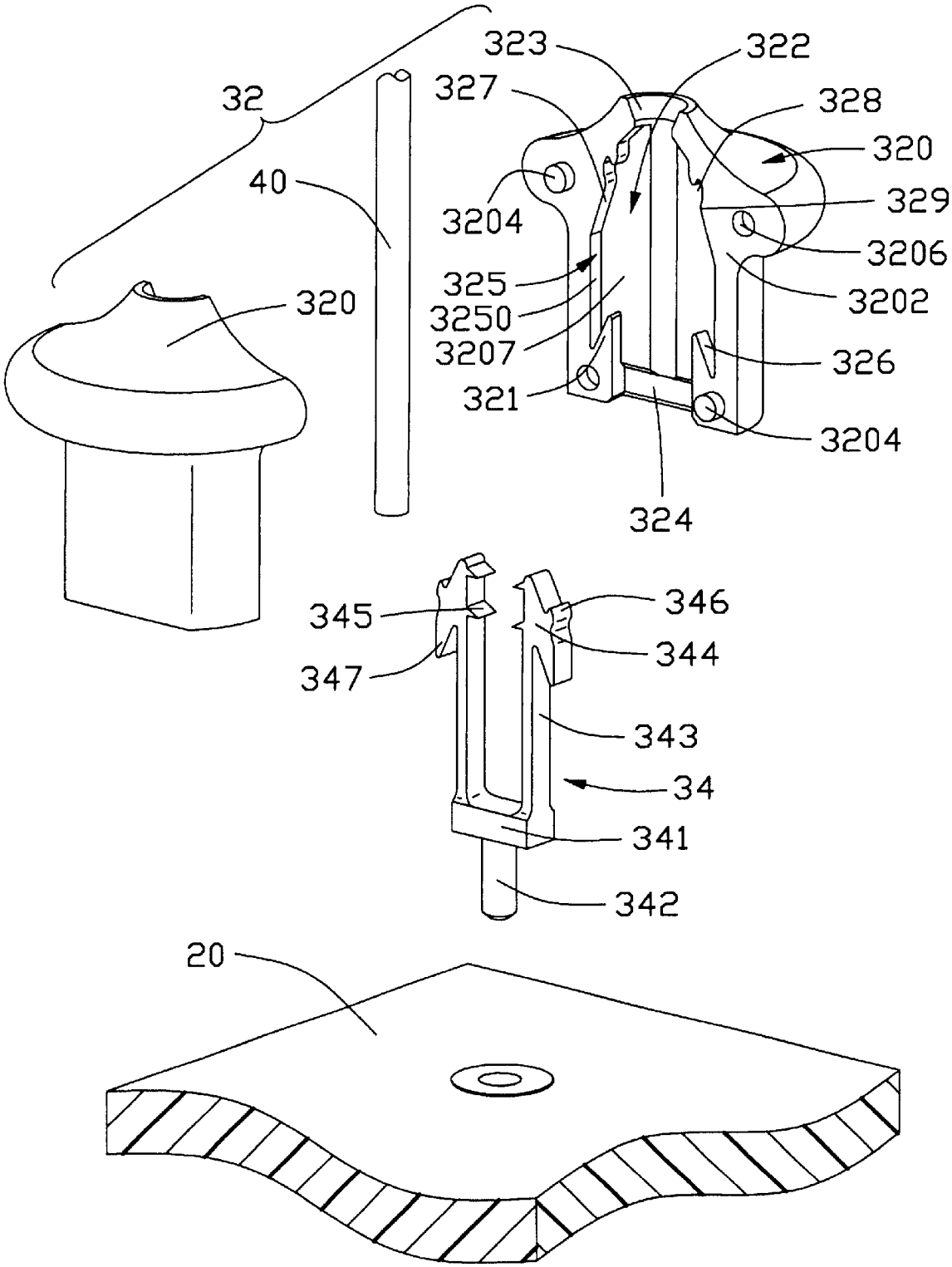
FIG. 2 is an exploded view of the IDC connector assembly separating from the PCB.

Referring to FIG. 2, the IDC connector 30 comprises an insulative housing 32 and a terminal 34.

The insulative housing 32 comprises a pair of half covers 320 having identical structures for engaging with each other. Each cover 320 has an engaging face 3202, a pair of posts 3204 formed on the engaging face 3202, and a pair of recesses 3206 defined in the engaging face 3202. Each cover 320 further defines a half cavity 3207 in the engaging face 3202 and both half cavities 3207 together form a hollow portion 322. The hollow portion 322 has an entrance 323 and an exit 324. Each cover 320 has a pair of shaped side portions 325 adjacent to both the cavity 3206 and the engaging faces 3202. Each shaped side portion 325 comprises a block 321 adjacent to the exit 324, a vertical side wall 3250, a groove 326 between the block 321 and the vertical side wall 3250, an incline 327 above the vertical side wall 3250, and a concavity 328 above the incline 327. A bump 329 is formed between the incline 327 and the concavity 328.

The terminal 34 comprises a base portion 341, a solder portion 342 extending downwardly from the base portion 341, a pair of arm portions 343 extending upwardly from the base portion 341, and a pair of head portions 344 formed at free ends of the arm portions 343. Each head portion 344 comprises a pair of barbs 345 extending inwardly, a projection 346 extending upwardly, and a tail positioning portion 347 below the projection 346 and extending downwardly.

Figure 3B:
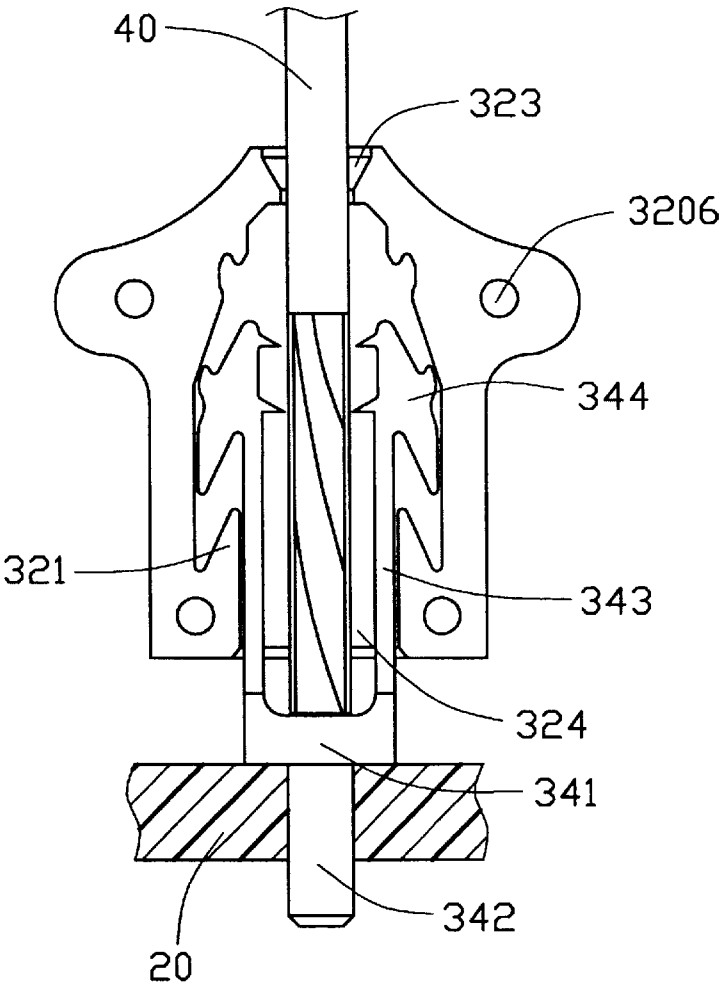
FIG. 3B is a side view of the IDC connector assembly showing the wire assembled between a pair of arm portions of the terminal.
Figure 3A:
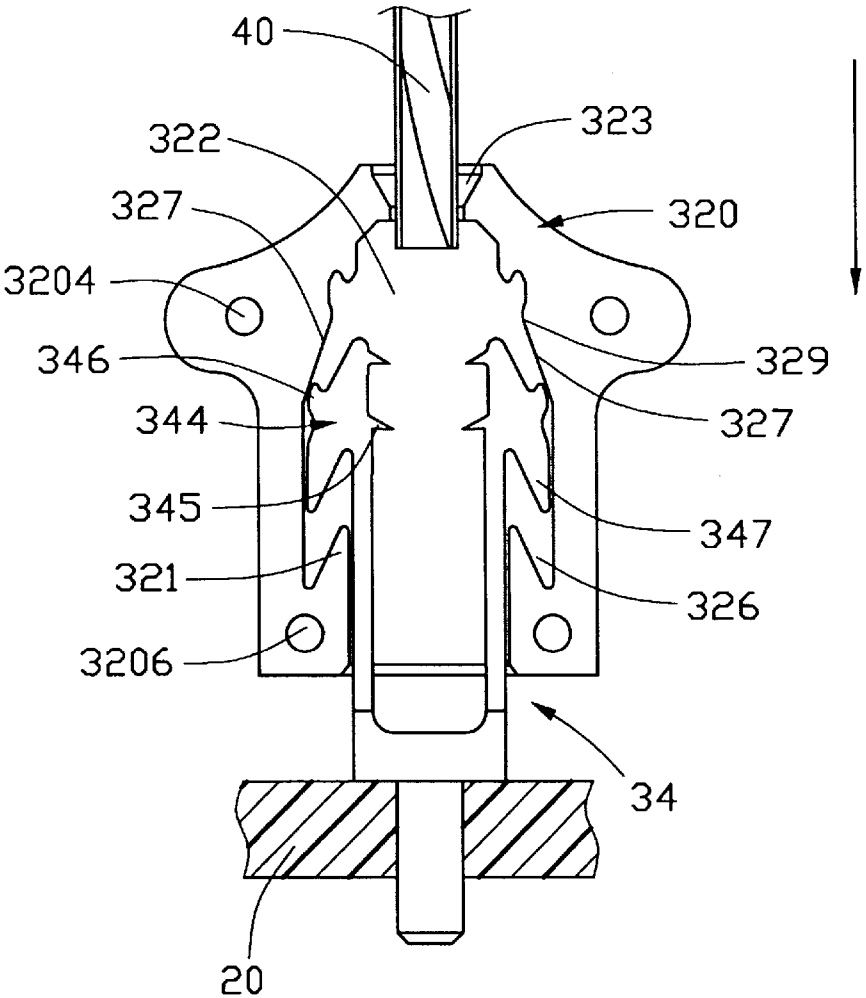
FIG. 3A is a side view of the IDC connector assembly showing a wire entering into an entrance of a housing with a cover of the housing being removed.

Referring to FIGS. 1, 2 and 3A, the terminal 34 is first inserted into one cavity of one cover 320 with the projection 346 abutting against the incline 327. The posts 3204 of each cover 320 are inserted into the corresponding recesses 3206 of the other cover 320 whereby both covers 320 are assembled with each other. The solder portion 342 of the terminal 34 is soldered to the PCB 20 with the base portion 341 abutting against the PCB 20.

Figure 3D:
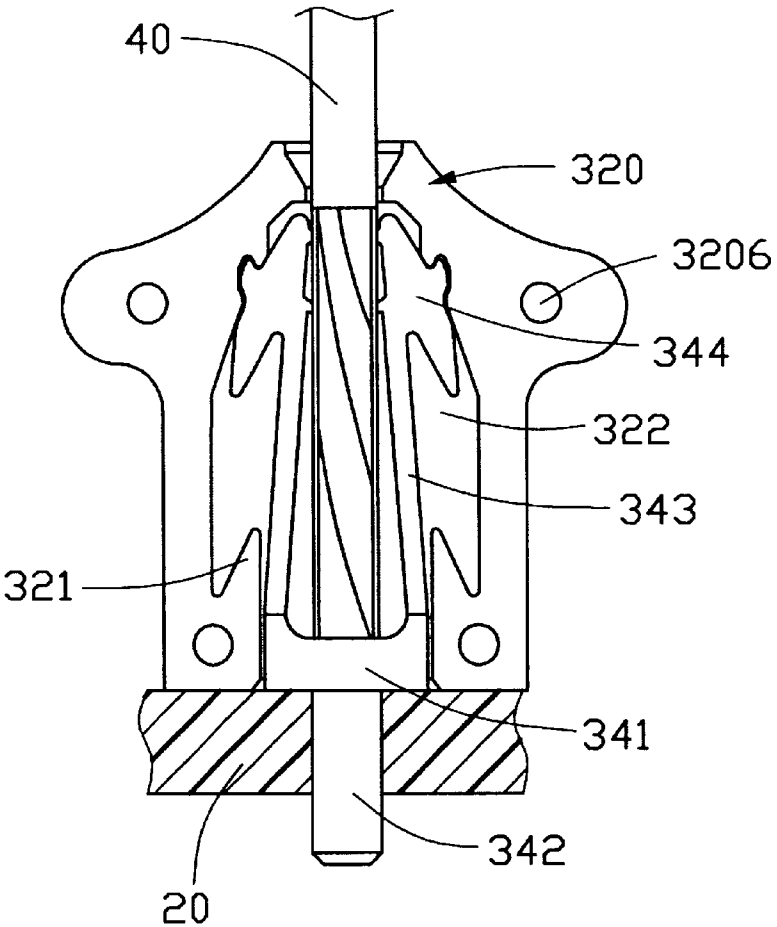
FIG. 3D is a side view of the IDC connector assembly showing the terminal positioned in the cover and electrically connecting with the wire.
Figure 3C:
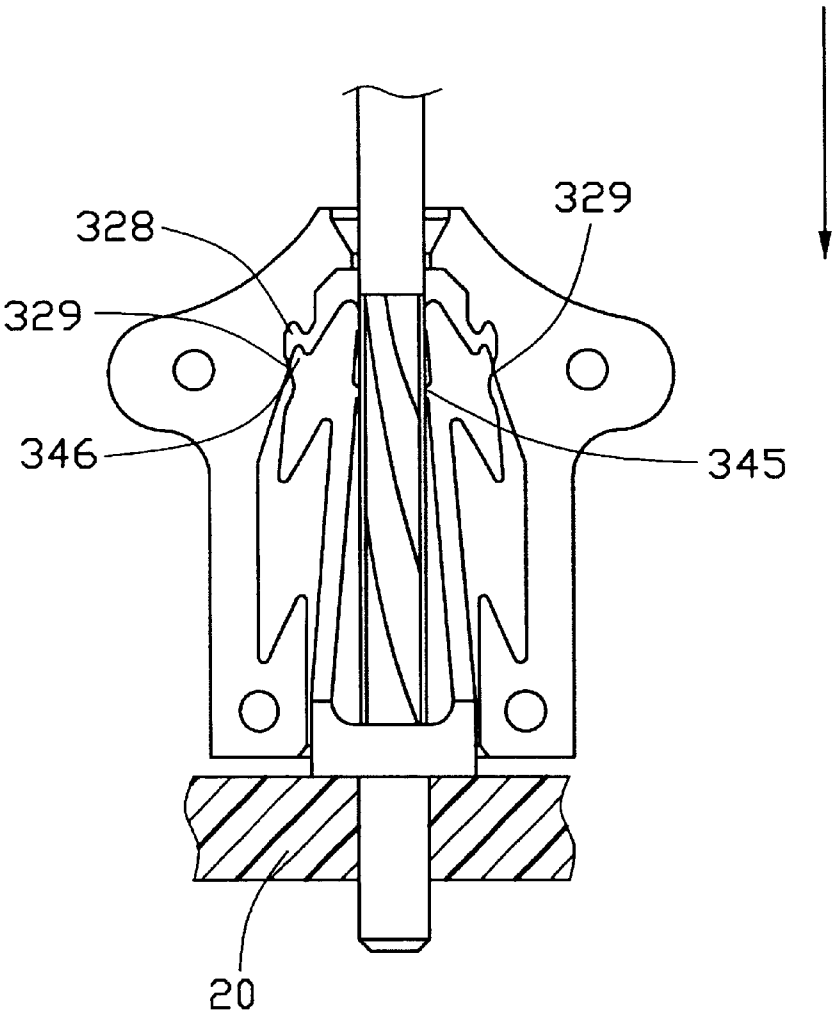
FIG. 3C is a side view of the IDC connector assembly showing the housing being moved downwardly with the terminal piercing into the wire.

Referring to FIGS. 3A–3B, the wire 40 is inserted into the hollow portion 322 of the housing 32 of the IDC connector 30 from the entrance 323 until abutting against the base portion 341 of the terminal 34. The housing 32 is moved downwardly, as the arrow sign indicates, with the projection 346 of the terminal 34 sliding upwardly along the incline 327. Referring to FIGS. 3C–3D, when the projection 346 slides to the bump 329, the barbs 345 pierce into the wire 40. When the projection 346 slides into the concavity 328, the housing 32 abuts against the PCB 20 so that the terminal 34 is positioned within the housing 32 whereby electrical connection is established between the wire 40 and the terminal 34.

Figure 4B:
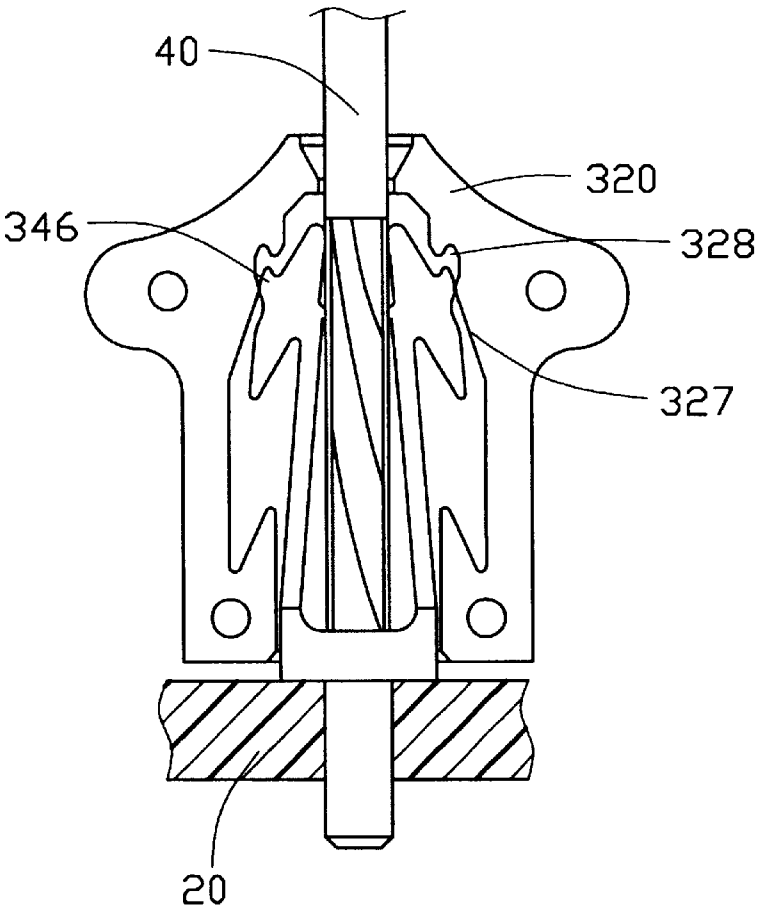
FIGS. 4A–4D are side views of the IDC connector assembly showing various stages that the housing are moved upwardly with the terminal dielectrically connecting with the wire.
Figure 4A:
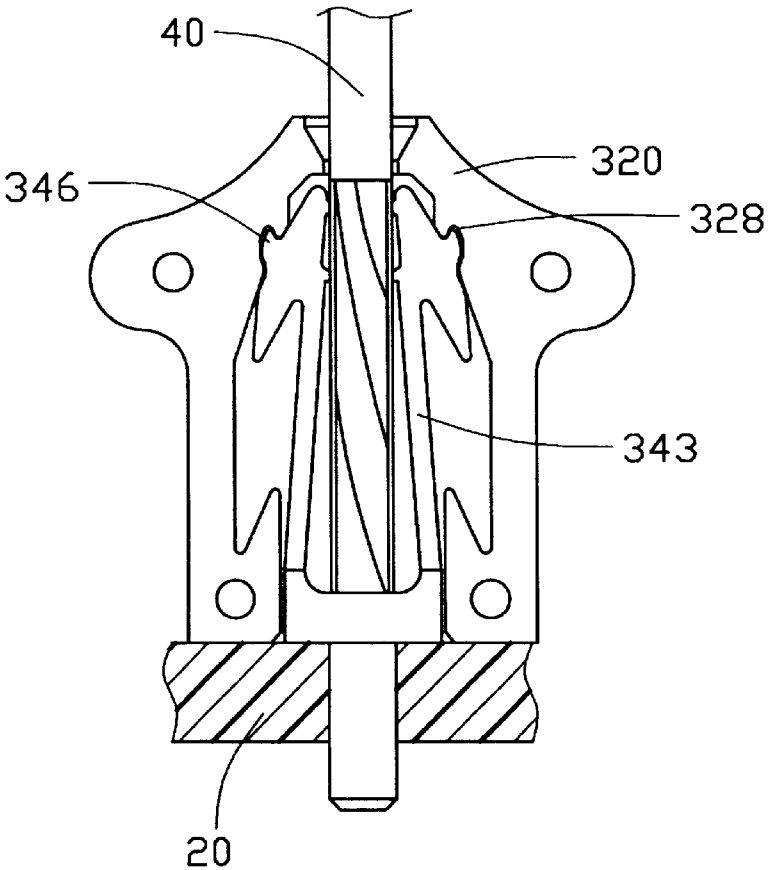
Figure 4D:
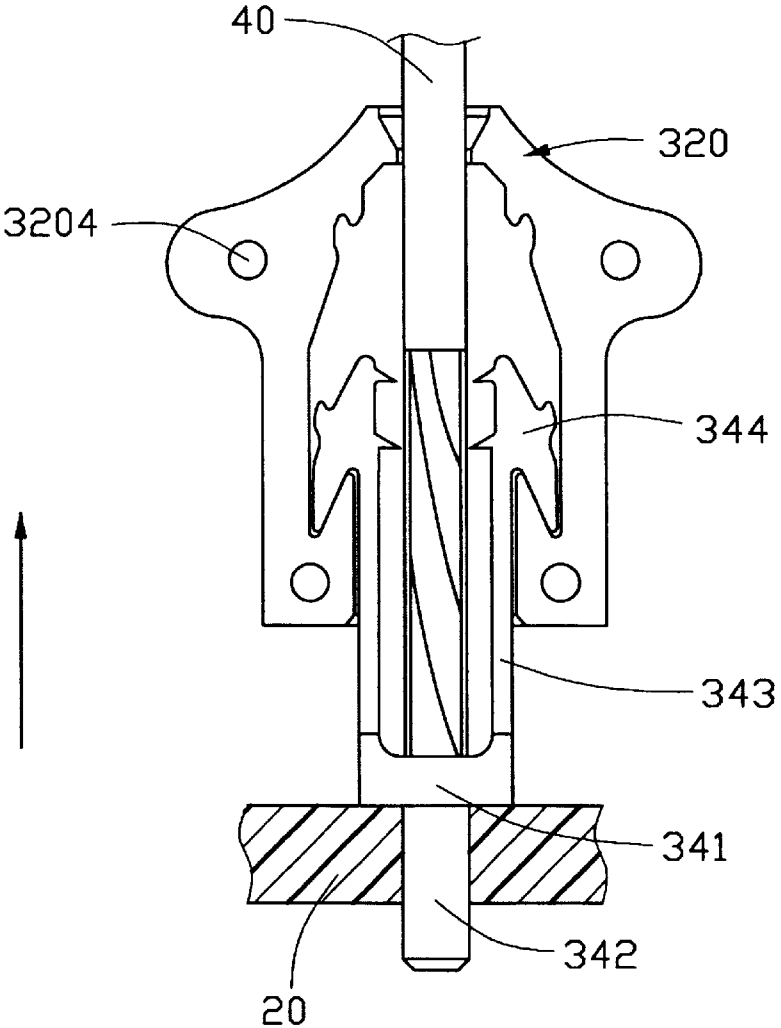
Figure 4C:
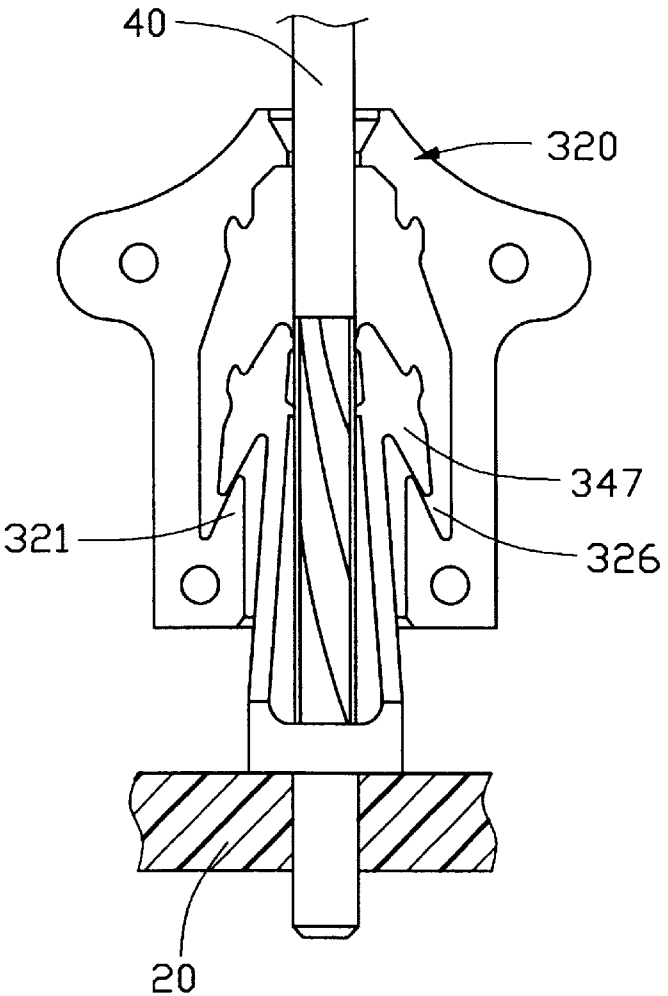

Referring to FIGS. 4A–4B, when the housing 32 is moved upwardly as indicated by the arrow sign, the projection 346 goes out the concavity 328. When the housing 32 is further moved upwardly, the projection 346 slides downwardly along the incline 327 and the tail positioning portion 347 enters into the groove 326 whereby the barbs 345 separate from the wire 40. Thus, the terminal 34 is not electrical with the wire 40. The housing 32 is easy to move upwardly and downwardly, and the terminal 34 is securely positioned within the housing 32 when the terminal 34 is in an electrical connection state with the wire 40 and is not in an electric connection state.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An insulation displacement connection (IDC) connector assembly for being mounted to a printed circuit board (PCB), comprising:

an IDC connector comprising:

a housing defining a hollow portion having an entrance and an exit;

a terminal received in the hollow portion and having a solder portion extending outside the exit of the hollow portion and adapted to be soldered to the PCB, a pair of arm portions extending into the hollow portion, and a pair of head portions respectively formed on the arm portions; and a wire extending into the hollow portion of the housing from the entrance to be located between the pair of arm portions, the pair of head portions piercing into the wire so that electrical connection is established between the wire and the terminal;

wherein each head portion comprises a plurality of barbs extending inwardly and a projection extending upwardly;

wherein the housing has a pair of shaped side portions, each shaped side portion comprises an incline and a concavity above the incline, and the projection of the head portion is slidable along the incline and is received into the concavity so that the barbs pierce into the wire;

wherein each head portion has a tail positioning portion below the projection of the head portion and extending downwardly, the shaped contour further comprises a groove at a lower end thereof, and the tail positioning portion is received into the groove when the terminal dielectrically connects with the wire.

2. An electrical connector assembly comprising:

an insulative housing defining a hollow portion with an entrance and an interior configuration thereof;

a terminal disposed in said hollow portion, said terminals defining an exterior contour; and a conductor inserted into the hollow portion through said entrance in a direction for electrical and mechanical engagement with said terminal; wherein said housing is moveable relative to the terminal along said direction, and said interior configuration and said exterior contour are characterized in that through engagement between said exterior contour and said interior configuration, said housing is prohibited from further moving away from said terminal when said housing is in an opening position with regard to said terminal where the conductor is able to be easily inserted into the hollow portion via said entrance, and said housing urges the terminals toward the conductor when said housing is in a closed position with regard to the terminal where the terminal and the conductor result in an electrical connection.

3. The assembly as described in claim 2, wherein said terminal further includes a portion exposed outside of the housing for connection with an electronic device other than said conductor.

4. The IDC connector assembly as described in claim 3, wherein the housing comprises a pair of covers securely engaging with each other and together defining the hollow portion to enclose the wire and the terminal therein.

5. The IDC connector assembly as described in claim 4, wherein each cover has at least one post and at least one recess, the post of one cover being securely received into the recess of the other cover.

* * * * *